US005438308A

United States Patent [19]

Leupold et al.

[11] Patent Number: 5,438,308

[45] Date of Patent: Aug. 1, 1995

[54] YOKELESS PERMANENT MAGNET SOLENOIDS

[75] Inventors: Herbert A. Leupold, Eatontown; Ernest Potenziani, II, Ocean, both of N.J.

[73] Assignee: The United States of America as represented by the Secretary of the Army, Washington, D.C.

[21] Appl. No.: 336,363

[22] Filed: Nov. 8, 1994

[51] Int. Cl.[6] ..... H01F 7/00

[52] U.S. Cl. ..... 335/306

[58] Field of Search ..... 335/302–306; 315/5.34, 5.35

[56] References Cited

U.S. PATENT DOCUMENTS 4,692,732 9/1987 Leupold et al. ..... 335/302
4,701,737 10/1987 Leupold ..... 335/301
5,014,028 5/1991 Leupold ..... 335/210
5,034,715 7/1991 Leupold et al. ..... 335/306

*Primary Examiner*—Leo P. Picard
*Assistant Examiner*—Raymond M. Barrera
*Attorney, Agent, or Firm*—Michael Zelenka; James A. DiGiorgio

[57] ABSTRACT

A yokeless magnetic circuit composed of a permanent magnet shell having a solenoidal-cavity within which a working field is generated. The permanent magnet shell has a conical permanent end magnet adjacent each of its ends to insure that the surface at each of its ends is equipotential between the radial periphery of the permanent magnet shell and the axial centerpoint of the solenoidal cavity. The height of the conical end magnets directly depends of the magnetization and thickness of the permanent magnet shell and whether the internal field is uniform, gradient or variable.

5 Claims, 2 Drawing Sheets

YOKELESS PERMANENT MAGNET SOLENOIDS

GOVERNMENT INTEREST

The invention described herein may be manufactured, used, and licensed by or for the Government for governmental purposes without the payment to us of any royalties thereon.

FIELD OF INVENTION

The invention relates to permanent magnet field sources, and more specifically to a permanent magnet structure that provides a confined working field in a solenoidal cavity without iron or passive magnet pole pieces, i.e. yokeless, for use in devices such as particle beam and plasma devices.

BACKGROUND OF THE INVENTION

Heretofore, several permanent magnet structures have been designed to provide solenoidal magnetic fields. Such structures are basically composed of a permanent magnet shell that forms a solenoidal cavity within which a working magnetic field having a predetermined strength is generated. Depending on the cladding around the shell, these internal working fields can be designed to be uniform or variable along the axial path of the solenoidal cavity.

Examples of such structures can be seen in U.S. Pat. No. 4,692,732 issued Sep. 8, 1987, entitled "Remanence Varying in a Leakage Free Permanent Magnet Field Source," and U.S. Pat. No. 4,701,737 issued Oct. 20, 1987, entitled "Leakage-Free, Linearly Varying Axial Permanent Magnet Field Source," by the present inventor. Both patents disclose a structure having passive ferro-magnets or iron pole pieces placed at either end of a solenoid permanent magnet shell that produces a working field in its solenoidal cavity. The iron pole pieces not only complete the magnetic circuit around the structure, they insure that the surfaces at each end of the solenoidal structure is equipotential. As a result, the surface at each end of the solenoidal structure has no radial change in magnetic potential between the magnetic shell or supply magnet and the axial centerpoint of the solenoidal cavity within which the internal field is confined.

In addition, some embodiments of such structures have cladding magnets of varying thickness and magnetization placed around the outer surface of the permanent magnet shell to insure that the internal field working field does not leak from the internal solenoidal cavity and to enhance the uniformity of the internal field. It is important to note, however, that depending on the shape and magnetization of the cladding magnets and the magnetization of the magnetic shell or supply magnet, the internal field can be made to vary along the axial path of the solenoid, and thus does not necessarily have to be uniform as shown in the two patents cited above. Typically, a hole is bored through the passive ferro-magnet pole pieces to provide access to the internal field whether uniform or gradient.

Although it is desirable for most applications to optimize the uniformity or the gradient of the internal working field, it is not always desirable to use iron or passive ferromagnet pole pieces to complete the magnetic circuit at the ends of such structures to insure that the end surfaces are equipotential as described above. For example, in applications where it is desirable to superimpose magnetic fields from separate sources to form a pattern having a particular distribution, such iron pole pieces would distort or even short out the superimposed field.

SUMMARY OF THE INVENTION

Accordingly, an object of the present invention is to provide a solenoidal permanent magnet structure that generates a solenoidal internal magnetic working field without using iron or passive ferromagnet pole pieces at each end of the permanent magnet shell, i.e. yokeless. To attain this, the present invention provides a solenoidal permanent magnet shell having conically-shaped permanent magnets or conical end magnets placed at either end of the solenoidal permanent magnet shell. More specifically, the conical end magnets provide equipotential surfaces at each end of the solenoid cavity and eliminate the problems associated with the prior art for most applications.

The size or height of the conical end magnets is critical to making the end surfaces of the solenoidal cavity radially equi-potential between the supply magnet shell and the axial centerpoint of the internal working field. In general, the height of the conical end magnet directly depends on remanence of the material comprising the end magnet itself and the difference in magnetic potential between the axial centerpoint of the solenoidal supply magnet and the radial periphery of the supply magnet shell.

More specifically, the height of a conical end magnet at each end of the solenoidal supply magnet is directly proportional to the difference between the magnetic potential of the shell of the supply magnet at that particular end and the magnetic potential at the axial centerpoint of the solenoidal cavity at that end, divided by the coercivity of the conical end magnet itself.

As a result, in an embodiment where the internal working field is desired to be uniform, the conical end magnets have an identical size and shape. Whereas, in an embodiment where the internal working field is not uniform or varies along a predetermined axis of the internal solenoidal working cavity, the conical end magnets can have different heights.

These and other features of the invention are described in more complete detail in the following description of the preferred embodiment when taken with the drawings. The scope of the invention, however, is limited only by the claims appended hereto.

DETAILED DESCRIPTION OF THE INVENTION

Figure 2:
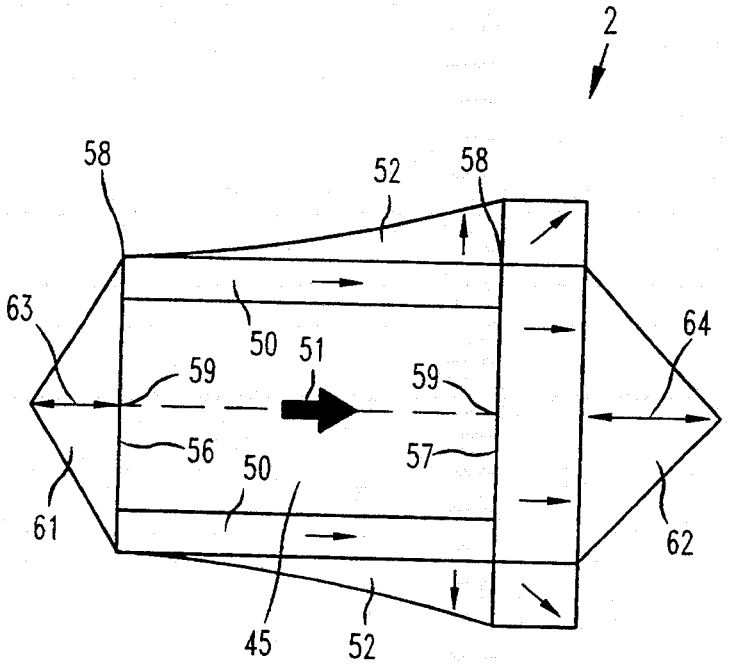
FIG. 2 is a cross sectional view of an embodiment of the invention wherein the internal working field is non-uniform.

Referring now to FIG. 2 there is shown a cross-section of embodiment 2 of the invention. As shown, solenoidal shell or supply magnet 50 is a permanent magnet having two opposing ends 56 and 57, a solenoidal periphery or radial periphery 58, and an axial center point or centerpoint 59. Supply magnet 50 is permanently magnetized in an axial direction such that it generates a solenoidal magnetic working field or internal field 51 within its solenoidal cavity 45 pointing in a predetermined direction.

Supply magnet 50 is coaxially circumscribed by cladding magnet or cladding magnets 52 which extend from end 56 to end 57. Cladding magnets 52 are radially magnetized along the longitudinal axis of supply magnet 50 such that the outer surface of the entire structure is magnetically equipotential at all points from end 56 to end 57, and such that the magnitude of internal field 51 is spatially variable from end 56 to end 57.

A pair of conical permanent magnets or conical end magnets 61 and 62 are positioned adjacent to ends 56 and 57, respectively. The height 63 of conical end magnet 61 is directly proportional to the difference between the magnetic potential at radial periphery 58 and centerpoint 59 of end 56, divided by the coercivity of the permanent magnet material comprising end magnet 61. Similarly, height 64 of conical end magnet 62 is directly proportional to the difference between the magnetic potential at radial periphery 58 and centerpoint 59 at end 57, divided by the coercivity of the permanent magnet material comprising conical end magnet 62. Since embodiment 2 has a spatially variable internal field 51, height 63 of conical end magnet 61 and height 64 of end magnet 62 may not be equal, depending on the coercivity of each end magnet 61 and 62.

In operation, supply magnet 50 works together with cladding magnets 52 to generate spatially variable internal field 51 within solenoidal cavity 45. Conical end magnets 61 and 62, in turn, compensate for any radial non-uniformities of internal field 51 at ends 56 and 57, respectively. Thus, overcoming to a large extent the limitations associated with the prior art.

Figure 1:
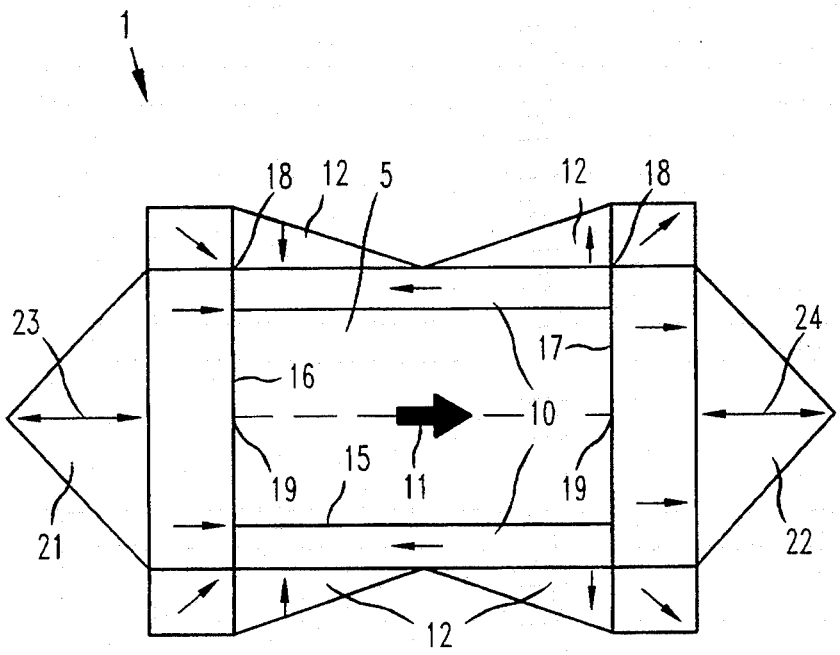
FIG. 1 is a cross-sectional view of an embodiment of the invention wherein the internal working field is uniform.

Referring now to FIG. 1 there is shown a cross-section of embodiment 1 of the invention. As shown, solenoidal shell or supply magnet 10 is a permanent magnet having two opposing ends 16 and 17, a solenoidal periphery or radial periphery 18, and an axial center point or centerpoint 19. Supply magnet 10 is permanently magnetized in an axial direction such that it generates a uniform solenoidal magnetic working field or uniform internal field 11 within its solenoidal cavity 5 pointing in a predetermined direction.

Supply magnet 10 is coaxially circumscribed by cladding magnet or cladding magnets 12 which extend from end 16 to end 17. Cladding magnets 12 are radially magnetized along the longitudinal axis of supply magnet 10 such that the outer surface of the entire structure is magnetically equipotential at all points from end 16 to end 17, and such that the magnitude of internal field 11 is uniform from end 16 to end 17.

A pair of conical permanent magnets or conical end magnets 21 and 22 are positioned adjacent to ends 16 and 17, respectively. The height 23 of conical end magnet 21 is directly proportional to the difference between the magnetic potential at radial periphery 18 and centerpoint 19 of end 16, divided by the coercivity of the permanent magnet material comprising end magnet 21. Similarly, height 24 of conical end magnet 22 is directly proportional to the difference between the magnetic potential at radial periphery 18 and centerpoint 19 at end 17, divided by the coercivity of the permanent magnet material comprising conical end magnet 22. As a result, since embodiment 1 has a uniform internal field 11, height 23 of conical end magnet 21 will be the same as height 24 of end magnet 22.

In operation, supply magnet 10 works together with cladding magnets 12 to generate uniform internal field 11 within solenoidal cavity 5. Conical end magnets 21 and 22, in turn, compensate for any radial non-uniformities of internal field 11 at ends 16 and 17, respectively. Thus, overcoming to a large extent the limitations associated with the prior art.

What is claimed is:

1. A yokeless magnetic circuit producing an internal magnetic field, comprising:

a permanent magnet shell having a solenoidal cavity within which the internal magnetic field is produced, said permanent magnet shell having at least a first and a second end, each said first and second end having a radial periphery and an axial centerpoint;

a first conical end magnet adjacent said first end of said permanent magnet shell; and a second conical end magnet adjacent said second end of said permanent magnet shell, said first and second end magnets having a predetermined coercivity, each said first and second conical end magnets providing an equipotential surface at said first and second ends of said permanent magnet shell between said radial periphery and said axial centerpoint.

2. The magnetic circuit of claim 1 wherein said first conical end magnet has a height directly proportional to the magnetic potential difference between said radial periphery and said axial centerpoint Of said first end, divided by said coercivity of said first conical end magnet.

3. The magnetic circuit of claim 1 wherein said second conical end magnet has a height directly proportional to the magnetic potential difference between said radial periphery and said axial centerpoint of said second end, divided by said coercivity of said second conical end magnet.

4. The magnetic circuit of claim 1 wherein the internal magnetic field is uniform.

5. The magnetic circuit of claim 1 wherein the internal magnetic field is variable.

* * * * *